US006923381B2

(12) United States Patent
Marshall et al.

(10) Patent No.: US 6,923,381 B2
(45) Date of Patent: Aug. 2, 2005

(54) RAILWAY RAIL FASTENING CLIP AND ASSEMBLY

(75) Inventors: Barry Marshall, Sheffield (GB); Christopher Gardner, Sheffield (GB); Lee Michael Chapman, Sheffield (GB)

(73) Assignee: Pandrol Limited, Surrey (GB)

( * ) Notice: Subject to any disclaimer, the term of this patent is extended or adjusted under 35 U.S.C. 154(b) by 0 days.

(21) Appl. No.: 10/398,077

(22) PCT Filed: Oct. 9, 2001

(86) PCT No.: PCT/GB01/04520

§ 371 (c)(1),
(2), (4) Date: Sep. 17, 2003

(87) PCT Pub. No.: WO02/31264

PCT Pub. Date: Apr. 18, 2002

(65) Prior Publication Data

US 2004/0056108 A1 Mar. 25, 2004

(30) Foreign Application Priority Data

Oct. 9, 2000 (GB) ..... 0024684

(51) Int. Cl.[7] ..... E01B 9/00
(52) U.S. Cl. ..... 238/351
(58) Field of Search ..... 238/349, 351, 238/338, 343, 352

(56) References Cited

U.S. PATENT DOCUMENTS 4,379,521 A 4/1983 Young et al. ..... 238/349
4,463,898 A * 8/1984 Young et al. ..... 238/310
4,688,719 A * 8/1987 Young et al. ..... 238/351
5,125,573 A 6/1992 Vanotti ..... 238/351
5,520,330 A 5/1996 Brown et al. ..... 238/351
6,367,704 B1 * 4/2002 Mediavilla ..... 238/310
6,431,463 B2 * 8/2002 Igwemezie ..... 238/264

FOREIGN PATENT DOCUMENTS

| | | |
|---|---|---|
| CH | 444206 | 9/1967 |
| GB | 696418 | 4/1951 |
| GB | 839237 | 6/1956 |
| GB | 808468 | 7/1957 |
| GB | 967694 | 7/1962 |
| GB | 1076718 | 11/1965 |
| GB | 2019923 | 11/1979 |
| WO | 9623107 | 8/1996 |

* cited by examiner

*Primary Examiner*—Mark T. Le
(74) *Attorney, Agent, or Firm*—Gottlieb Rackman & Reisman PC

(57) ABSTRACT

A railway rail fastening clip, for fastening a railway rail to an underlying rail foundation, is formed of an elongate plate shaped such that a central region of the plate has in profile the form of a letter C, a first end region of the plate extending from one side of the central portion of the plate to form a base portion of the clip for engaging a rail fastening anchoring device secured to the rail foundation and a second end region of the plate extending from the opposite side of the central region of the plate to form a toe portion of the clip for bearing on the railway rail. The toe portion of the clip is provided with an insulator retainer for retaining thereon a toe insulator for electrically insulating the clip from the rail.

28 Claims, 10 Drawing Sheets

RAILWAY RAIL FASTENING CLIP AND ASSEMBLY

The present invention relates to a railway rail fastening assembly incorporating a clip which can be kept captive in the assembly.

One type of captive rail fastening clip, which is driven onto the rail perpendicularly thereto, is disclosed in EP-B-0619851. This clip is a M-shaped clip formed of a rod of material and can be used with a two-part insulator system, i.e. a toe insulator carried by the toe of the clip and a sidepost insulator which is carried by the clip anchoring device. This captive clip has the advantage that it can be retained by the clip anchoring device in a pre-assembly position in which the toe of the clip does not bear on the rail and yet also retains the toe and sidepost insulators, thus facilitating track installation and maintenance. However, no clip made of plate material has hitherto been proposed which is operable in the same manner. GB696418 discloses an assembly having a plate-form clip carrying a toe insulator, but the clip is not held captive in the assembly.

According to the present invention there is provided a railway rail fastening assembly for fastening a railway rail to an underlying rail foundation, the assembly comprising: a railway rail fastening clip having a first, toe portion for bearing on the railway rail and a second portion for engaging a rail fastening anchoring device secured to the rail foundation, the clip being held captive in the assembly against unintentional removal from the device; an electrically insulating toe insulator having a cavity within which the toe portion of the clip is located, whereby the clip is electrically insulated from the rail, the insulator being retained on the toe portion of the clip by insulator retaining means provided on the clip and insulator; and a rail fastening clip anchoring device having a passageway within which the second portion of the clip is located when the clip is bearing on the rail; characterised in that the clip is formed of an elongate plate shaped such that a central region of the plate has in profile the form of a letter C, a first end region of the plate extending from one side of the central region to form the said second portion of the clip, which serves as a base portion, and a second end region of the plate extending from the opposite side of the central region of the plate to form the said toe portion of the clip; and in that an upper surface of the anchoring device is formed with a step which engages the toe insulator to inhibit unintentional removal of the clip from the device.

Preferably, the toe portion of the clip comprises, proceeding from the central region of the plate, a first section, extending towards the base portion of the clip, and then a straight second section extending away from the base portion, the insulator retaining means being provided on said second section.

The insulator retaining means desirably comprise a notch formed in the toe portion-for engaging with a projection on the toe insulator, which notch preferably extends across the toe portion.

Preferably, the toe portion is bifurcated and each part of the toe portion is provided with insulator retaining means for retaining thereon respective toe insulators for electrically insulating the clip from the rail. In this case the insulator retaining means preferably comprise respective notches formed in each part or the toe portion for engaging with respective projections on the toe insulators, the notches desirably extending respectively across the parts of the toe portion. Preferably, the central portion of the plate is not bifurcated.

The or each notch may be provided on a lower surface of the toe portion. Preferably, the or each notch has an abutment face which is substantially perpendicular to the direction in which the clip is to be driven onto the rail. In this case, the or each notch also has an inclined face extending away from and opposite to the said abutment surface.

The width of the toe portion may be substantially the same as that of the base portion.

Desirably, the base portion is planar.

In a preferred embodiment the base portion has a recess, provided adjacent to a free end of the base portion, for engaging part of the rail clip anchoring device. Desirably, the recess is provided on an upper surface of the base portion.

The passageway of each anchoring device preferably has a roof. Desirably, a locating projection is formed on the roof inside the passageway in the anchoring device for engaging with a recess on the base portion of the clip.

Preferably, the roof extends over almost the entire passageway.

The assembly may further comprise a pair of sidepost insulators for insulating the anchoring devices from the rail, each anchoring device having means for locating a sidepost insulator thereon.

Each anchoring device preferably has an aperture at the end of the passageway opposite to an entrance thereof, and each sidepost insulator has a portion which projects into that aperture, the portion of the sidepost insulator projecting into the aperture having a recess therein into which the base portion of the clip projects, thereby to prevent vertical displacement of the sidepost insulator.

Alternatively, or additionally, each anchoring device may have a protrusion and a recess at the end of the passageway adjacent to the sidepost insulator and each sidepost insulator may have a protrusion which projects into the recess, which protrusions act to resist unintentional vertical displacement of the sidepost insulator.

Reference will now be made, by way of example, to the accompanying drawings, in which.

Figure 1:
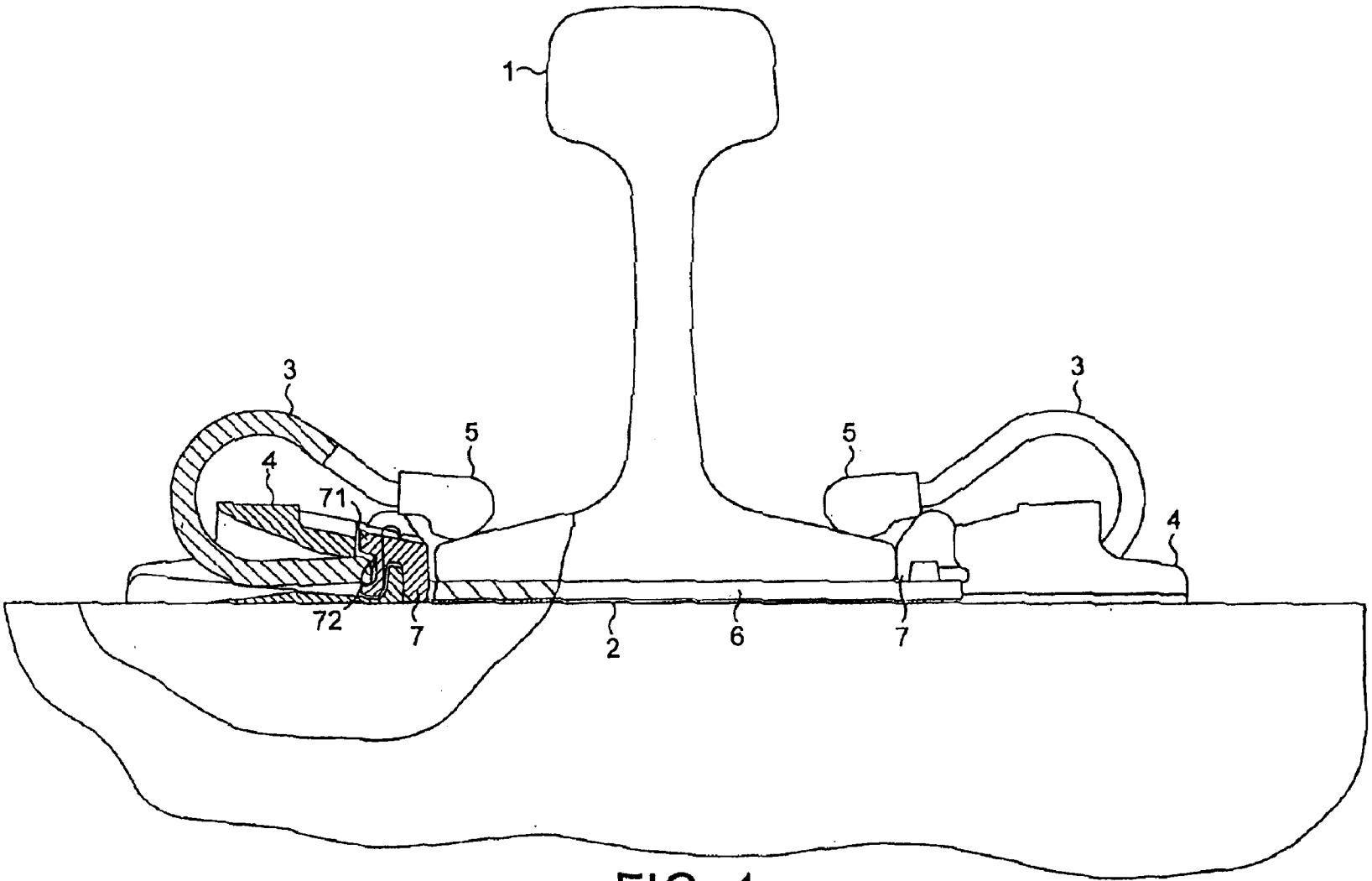
FIG. 1 shows a side view, partly in cross-section taken on line I—I in FIG. 3, of a railway rail fastening assembly embodying the present invention.

The assembly of FIG. 1 comprises a railway rail 1 fastened to an underlying rail foundation 2 by means of a pair of railway rail fastening clips 3 embodying the present invention which are anchored in respective rail fastening anchoring devices 4 and carry respective toe insulators 5 for electrically insulating the clip 3 from the rail 1. The foot of the rail 1 rests on a resilient rail pad 6 and the rail fastening anchoring devices 4 are insulated from the rail 1 by means of sidepost insulators 7.

The assembly is designed to allow the clip 3 to be driven into the anchoring device 4 so as to be held in a pre-assembly position in which the toe and sidepost insulators 5, 7 are also held captive, allowing rail foundations 2 to be delivered to site already equipped with a complete rail fastening assembly, which greatly improves the speed of track installation. After installation the clip 3 can also be driven off the rail 1 back into the pre-assembly position, thereby allowing track maintenance to be carried out without the need to remove the clips 3 from the anchoring devices 4.

A clip 3 embodying the present invention is shown in FIGS. 4 to 7. Clip 3 is made from an elongate plate shaped so as to have a central portion 31 having in profile the form of a letter C. A planar part extending from one end of the C-shaped part 31 forms a base portion 32 of the clip 3. Adjacent to a free end 36 of the base portion 32 there is formed a recess 35 which extends across an upper surface of the base portion 32. The recess 35 engages with part of the rail fastening anchoring device 4 when the clip 3 is installed therein to assist in locating the clip 3 in the anchoring device 4. The free end 36 of the base portion 32 has a chamfer on its upper edge 37A. On the other side of the central portion 31 the plate is bent to form a toe portion 33 of the clip 3. The toe portion 33 comprises two parts 33A and 33B separated by a gap 38, each of the parts 33A, 33B having across respective lower surfaces thereof respective notches 34A, 34B, adjacent to the free ends 39A, 39B of the parts 33A, 33B. The free ends 39A, 39B have respective upper and lower chamfered edges 40A, 40B. The first section of the toe portion 33 bends down from the end of the central portion 31 towards the base portion 32 and then a second section of the toe portion 33 extends away from the central portion 31 and base portion 32.

Figure 8A:
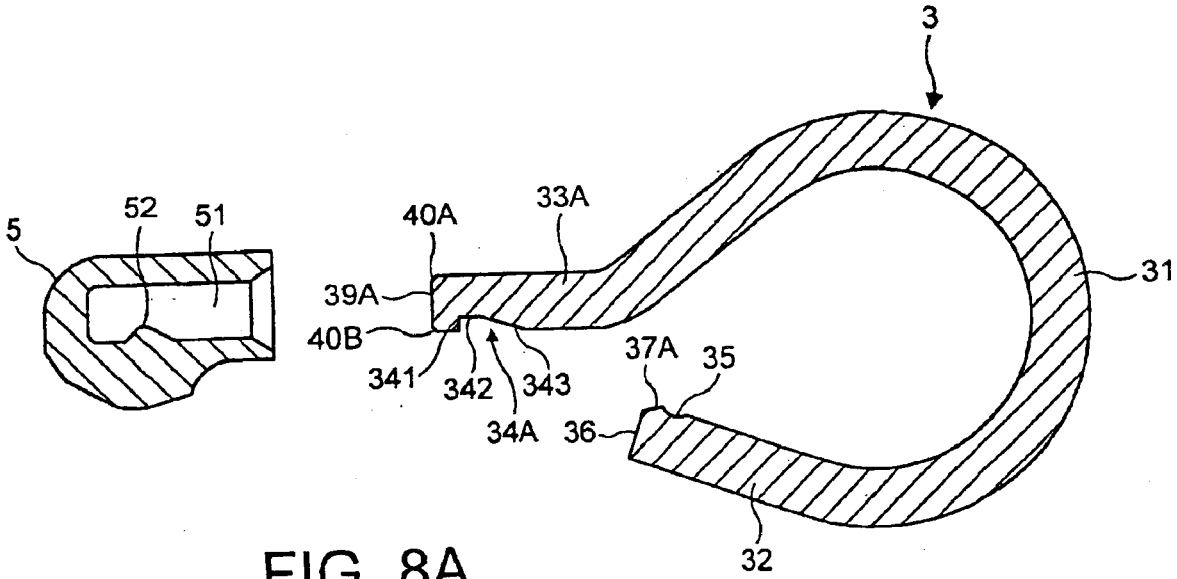
FIGS. 8A and 8B show respective cross-sectional views, taken on the line VIII—VIII in FIG. 5, of the clip of FIG. 4 and an insulator before and after attachment of the insulator to the clip.
Figure 8B:
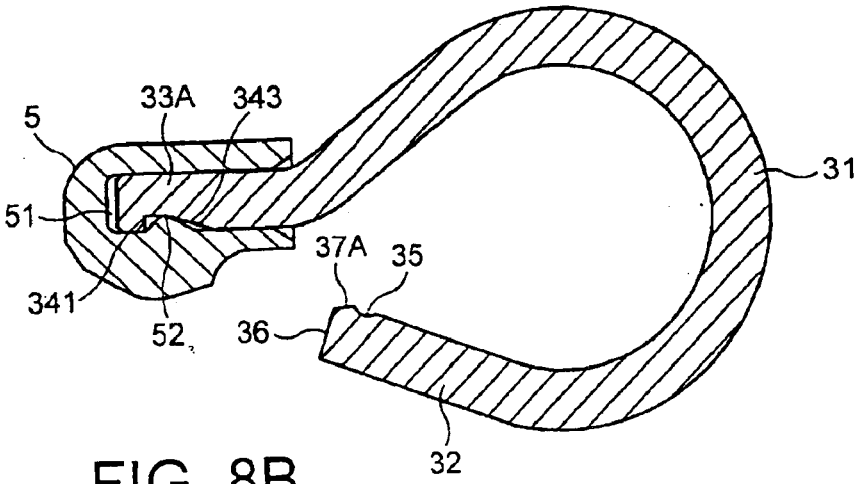
Figure 9:
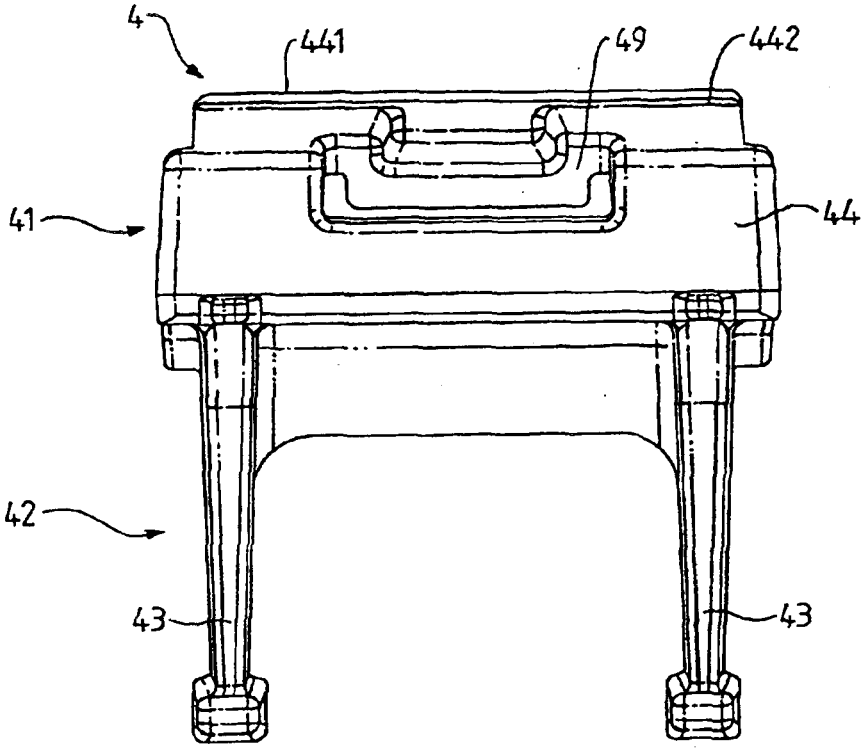
FIG. 9 shows a front view of a rail fastening anchoring device for use in the assembly of FIG. 1.
Figure 10:
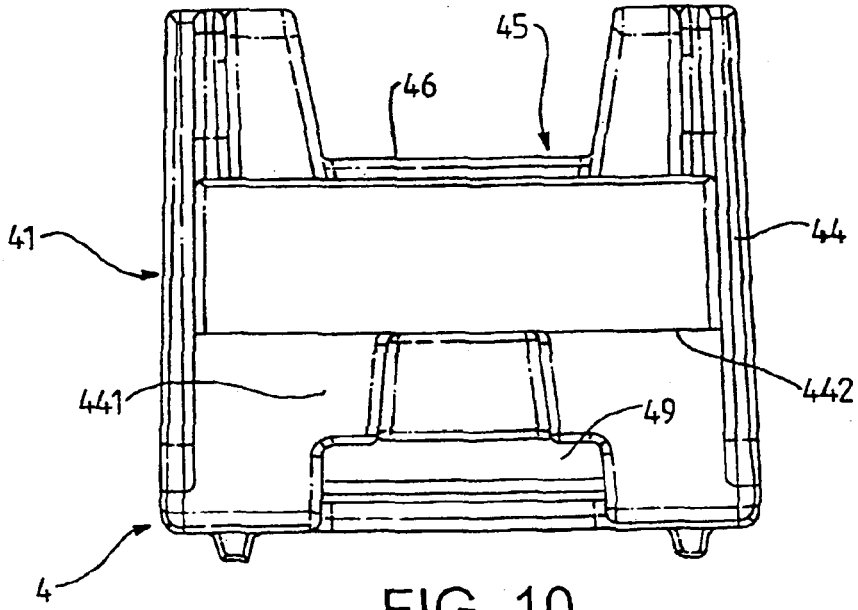
FIG. 10 shows a plan view from above of the device of FIG. 9.
Figure 11:
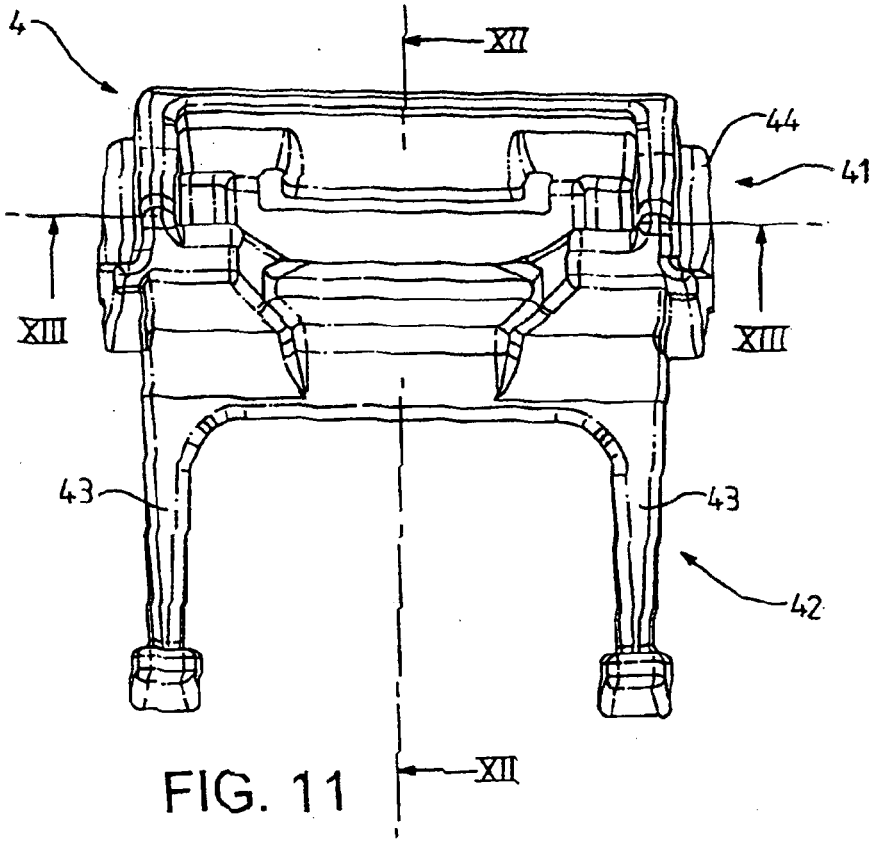
FIG. 11 shows a rear view of the device of FIG. 9.
Figure 12:
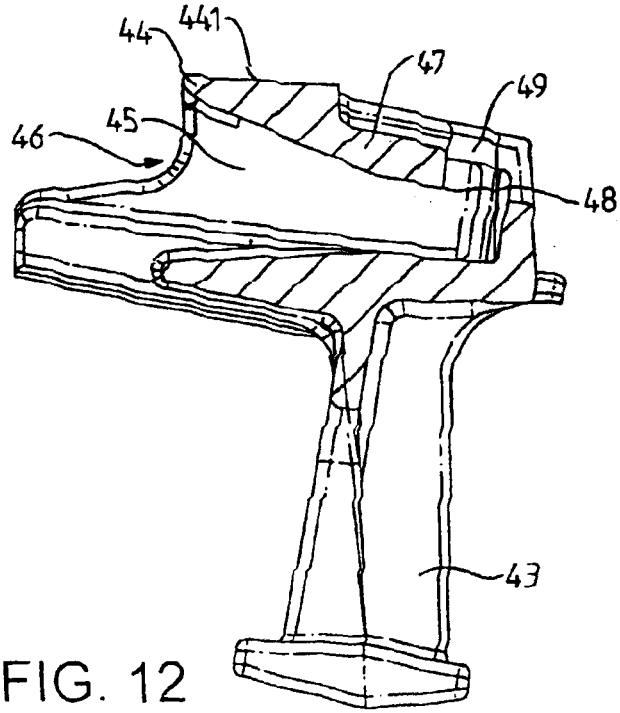
FIG. 12 shows a cross-sectional side view taken on the line XII—XII in FIG. 11.
Figure 13:
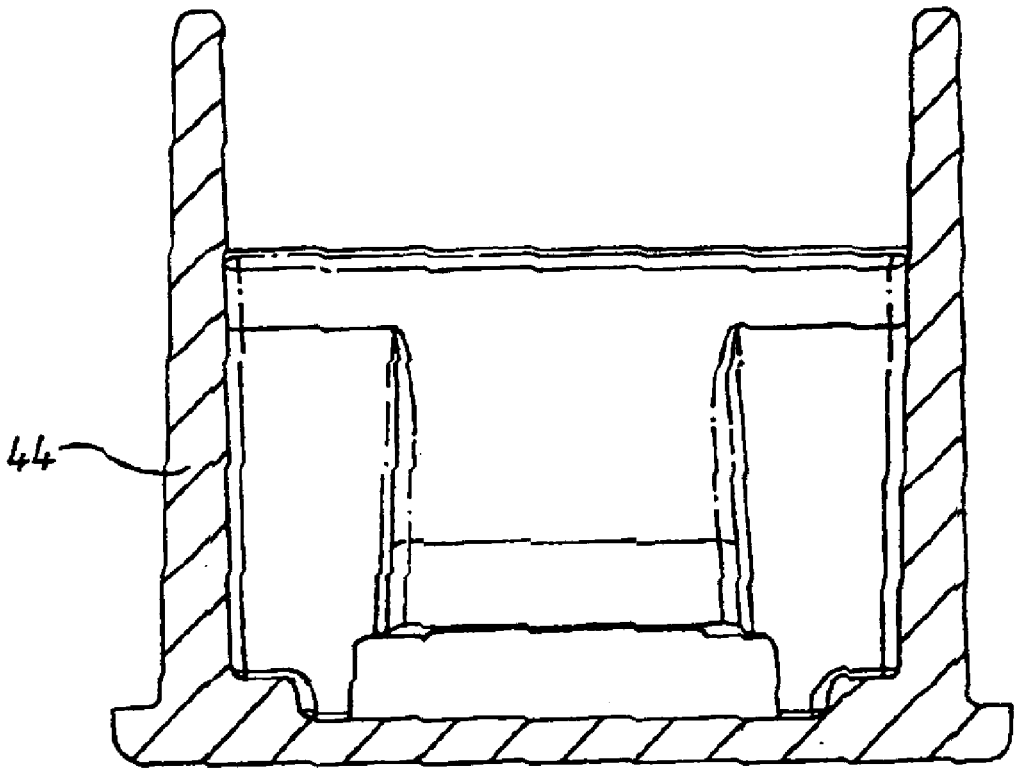
FIG. 13 shows a cross-sectional plan view taken on the line XIII—XIII in FIG. 11.

The notches 34A, 34B each have, as shown most clearly in FIGS. 8A and 8B, an abutment face 341 substantially perpendicular to the direction in which the clip is to be driven, and in this embodiment also substantially parallel to the end face 39A, and an inclined face 343, joined together by a wall 342 which extends approximately perpendicularly to the abutment face 341. The notches 34A, 34B are provided as means for retaining the insulators 5 on the toe of the clip 3. As shown in FIGS. 8A and 8B, each insulator 5 is made of electrically insulating material having a cavity 51 shaped so as to fit snugly onto the second section of the part 33A or 33B of the toe portion 33. Insertion of the second section of the toe parts 33A, 33B into the insulators 5 is eased by the provision on the toe parts 33A, 33B of the chamfered edges 40A, 40B. Inside the cavity 51 a projection 52 is formed which, when the part 33A or 33B is inserted into the cavity 51, the chamfered edge 40B of the part 33A (33B) rides up and over, the part 33A (33B) coming to rest within the insulator cavity 51 such that the projection 52 is located in the notch 34A (34B). The material of the insulator 5 beneath the cavity 51 is thicker than that at the top thereof and is shaped so as to have no sharp corners which would impede the driving of the clip 3 onto the rail 1. The notches 34A, 34B are designed such that the insulators 5 are retained firmly on the toe 33 of the clip 3 during both driving of the clip 3 into the anchoring device 4 and withdrawal of the clip 3 from the rail 1.

By way of example only, a clip embodying the present invention may have the following dimensions: the clip width, which is constant at the toe portion, base portion and central region, is 76 mm; the clip length as measured perpendicularly from the end face 39A (39B) to the furthest outer edge of the central region 31 is 92 mm; the central region 31 has an inner diameter of 42 mm; the length from the end face 36 to the furthest outer edge of the central region is 56 mm; the base portion 32 extends at an angle of 19° to the second section of the toe portion 33; the recess 35 has a depth of 0.5 mm and the surface of recess 35 has a radius of curvature of 2 mm, the centre of which is located 4 mm from the end face 36 of the base portion 32; the abutment face 341 of the notch 34A (34B) is 2 mm long and is located 4 mm from the end face 39A (39B) of the toe part 33A (33B), the wall 342 extends for a further 3 mm and the inclined face 343 is inclined at an angle of 15.9° to the second section of the toe portion 33; the length of the second section of each toe part 33A, 33B is 21.35 mm, the radius of curvature of the bend in the toe parts 33A, 33B being 10 mm; and the height of the toe portion 33 above the base portion 32 is 9 mm.

Figure 2:
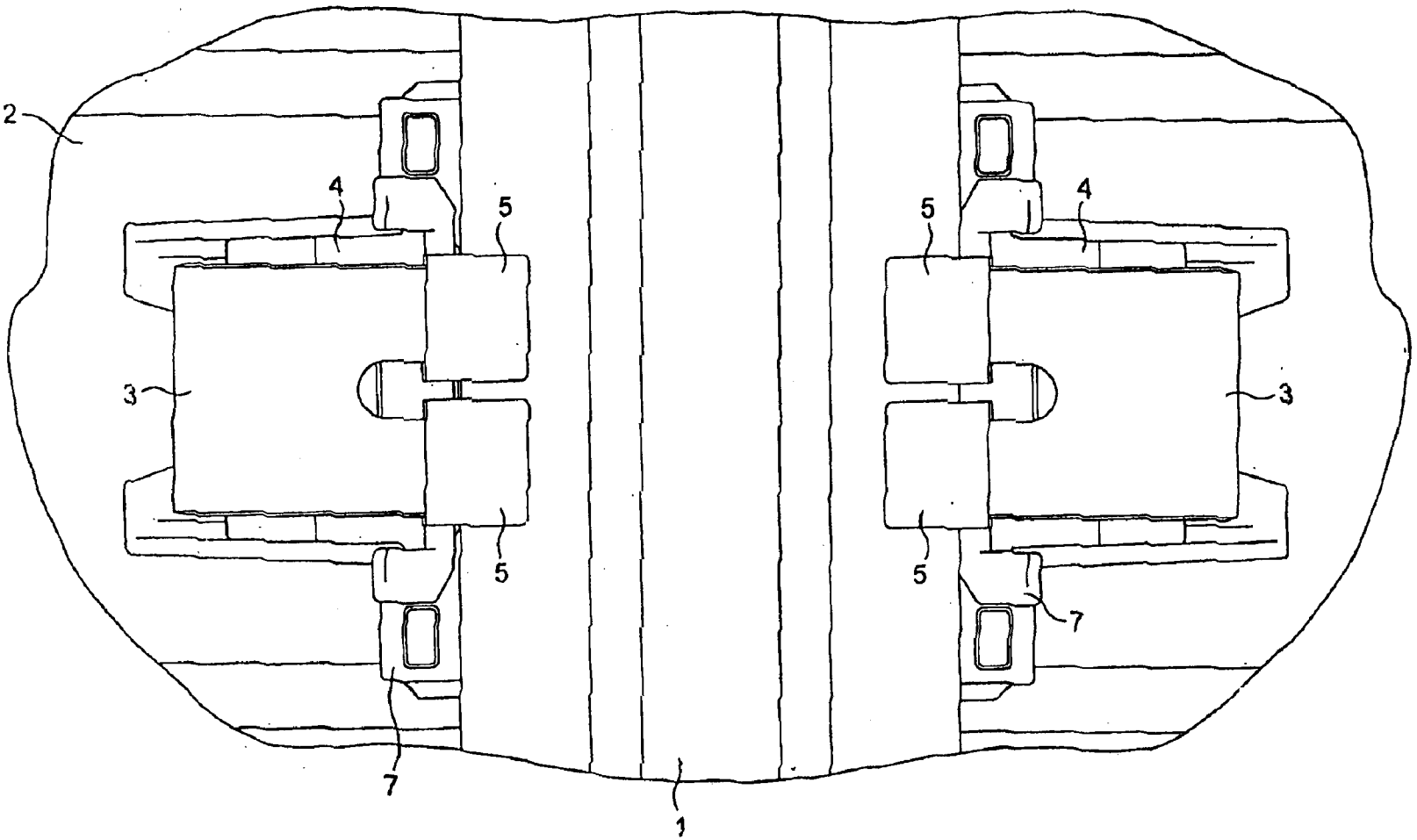
FIG. 2 shows a plan view of the assembly of FIG. 1.
Figure 3:
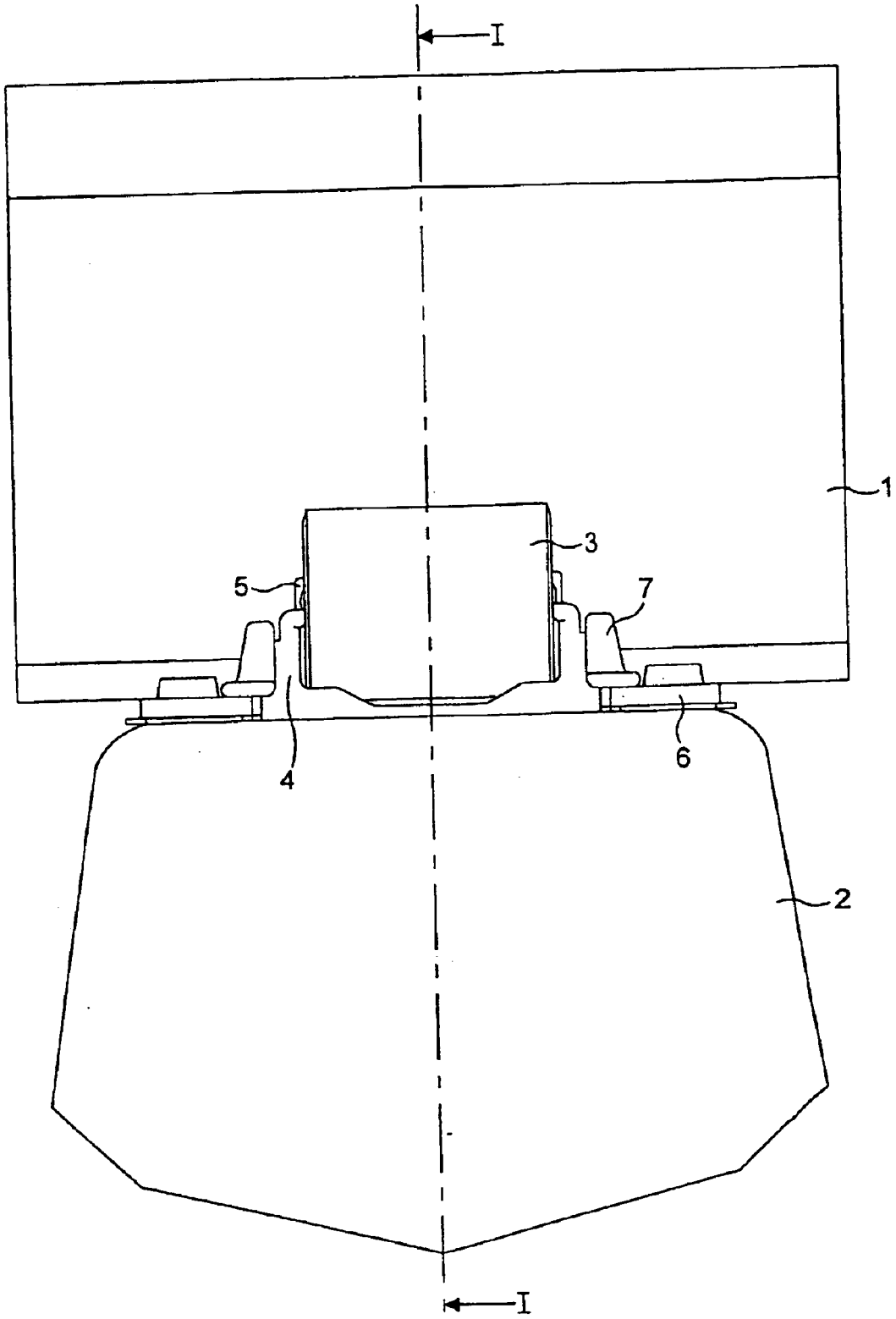
FIG. 3 shows a rear view of the assembly of FIG. 1.
Figure 4:
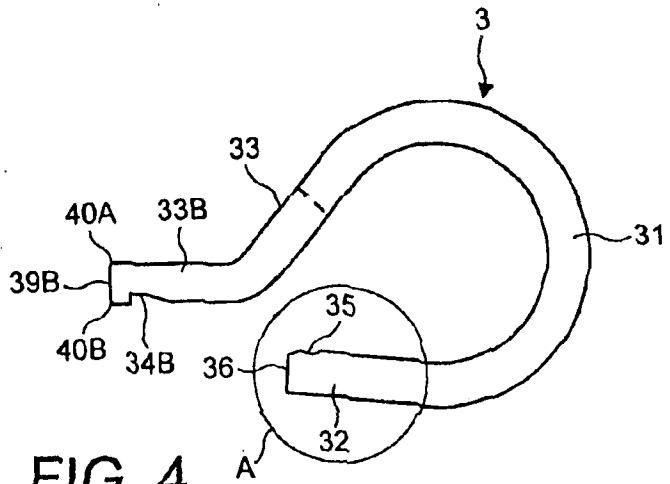
FIG. 4 shows a side view of a railway rail fastening clip embodying the present invention.
Figure 5:
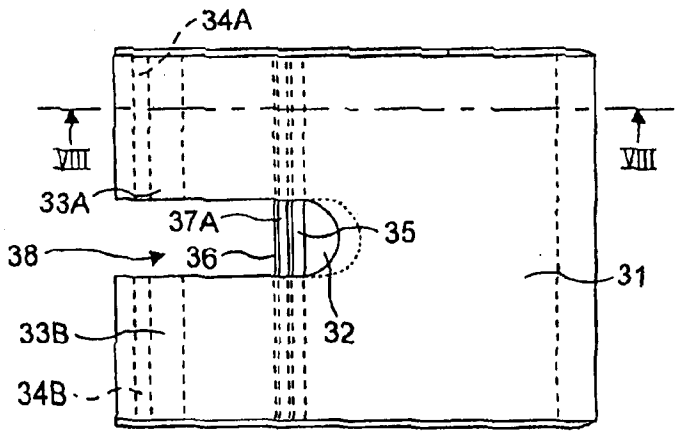
FIG. 5 shows a plan view from above of the clip of FIG. 4.
Figure 6:
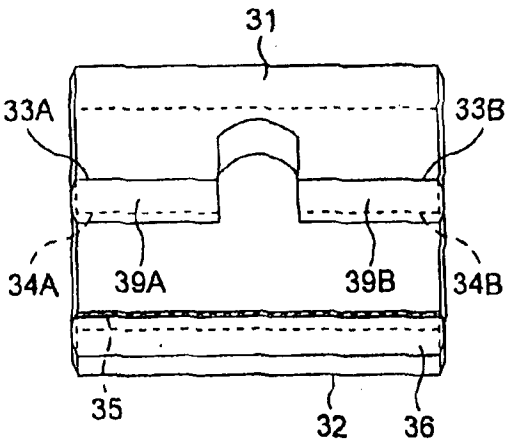
FIG. 6 shows a front view of the clip of FIG. 4.
Figure 7:
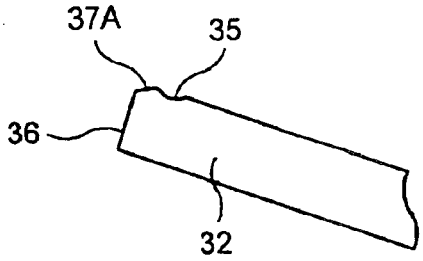
FIG. 7 shows an enlarged side view of part of the clip of FIG. 4.

The rail fastening anchoring device 4 of the assembly shown in FIGS. 1 to 3 is shown in more detail in FIGS. 9 to 13. Anchoring device 4 has an upper section 41 which extends above the rail foundation 2 and a lower section 42 which extends into the rail foundation 2. Lower section 42 includes a pair of legs 43 designed to prevent vertical and horizontal displacement of the anchoring device 4 in the rail foundation 2. The upper section 41 of the device 4 provides a body 44 through which there is a passageway 45 having an entrance 46 at the rear of the anchoring device 4. The passageway 45 has a roof 47 which extends over almost all of the passageway 45; an opening 49 is left in the roof 47 to receive a part 71 of the sidepost insulator 7 which in use is located on the front of the anchoring device 4. Since the passageway 45 is enclosed, track ballast cannot intrude into the anchoring device 4, thereby ensuring that withdrawal of the clip 3 from the rail 1 and subsequent driving of the clip 3 back onto the rail 1 are not impeded. An end portion 48 of the roof 47 inside the passageway 45 which is adjacent to the front of the anchoring device 4 serves as a locating projection which engages the recess 35 in the base portion 32 of the clip 3. As mentioned above, the sidepost insulator 7, as shown most clearly on the lefthand side of FIG. 1, has a portion 71 which projects into the aperture 49 in the roof 47. A recess 72 is formed in the portion 71 and the free end 36 of the base portion 32 extends into this recess 72 so as to prevent vertical displacement of the sidepost insulator 7.

The clip 3 has three points of contact with the assembly, that is between the toe portion 33 and the rail, between a lower portion of the C-shaped part 31 and the base of the anchoring device 4, and between the recess 35 in the base portion 32 and the end portion 48 of the anchoring device 4.

Figure 14:
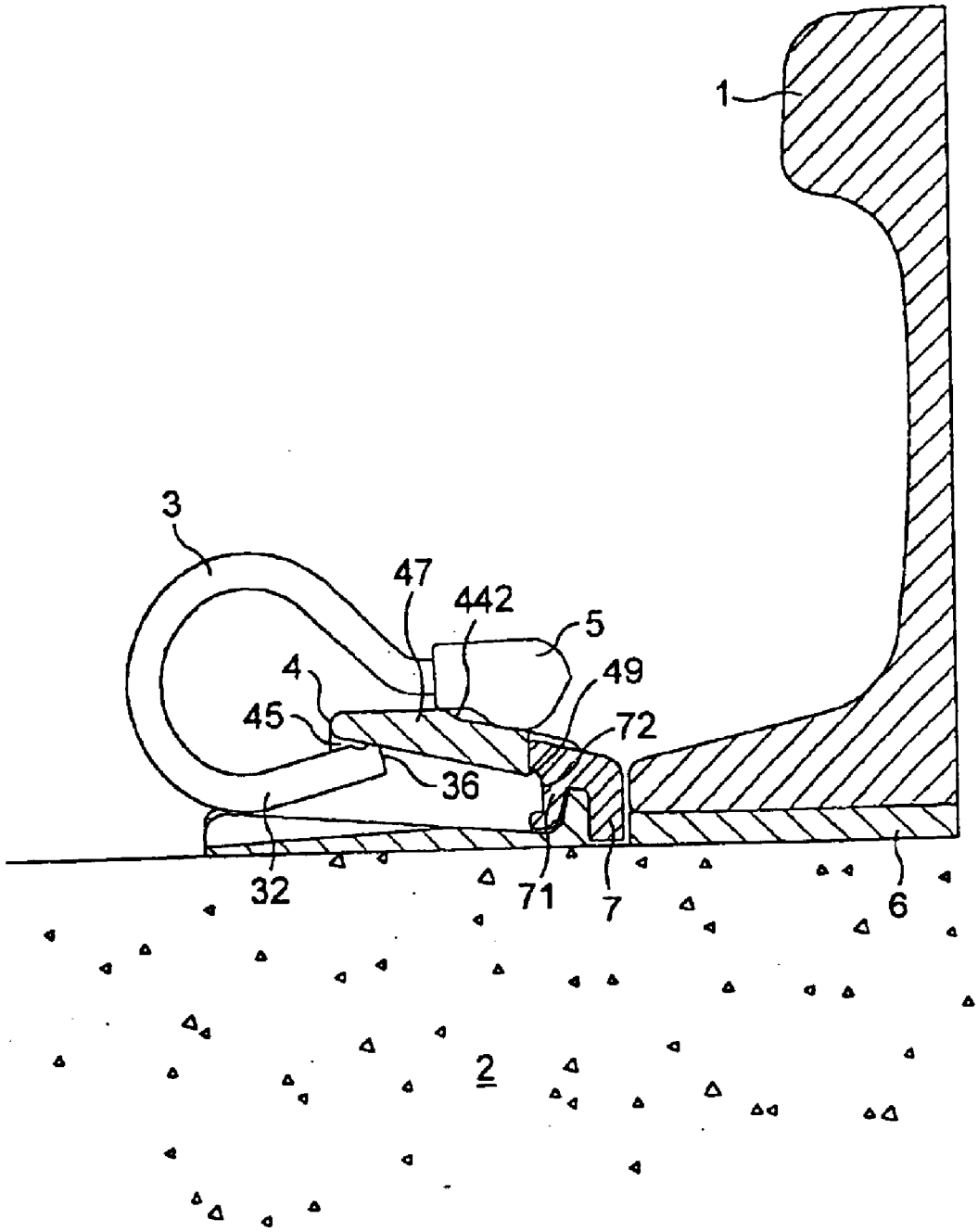
FIG. 14 shows a view of the assembly of FIG. 1 with the clip in a pre-assembly position.

As shown in FIG. 14, on installation of the clip 3 into the device 4, or on subsequent withdrawal of the clip 3 from the rail 1, the clip 3 can be "parked" in a pre-assembly position in which the free end 36 of the base portion 32 bears against the roof 47 of the passageway 45 and the toe insulator 5 bears on an upper surface 441 of the body 44 of the device 4 which is formed with a step 442 to inhibit unintentional withdrawal of the clip 3 from the device 4.

Figure 15A:
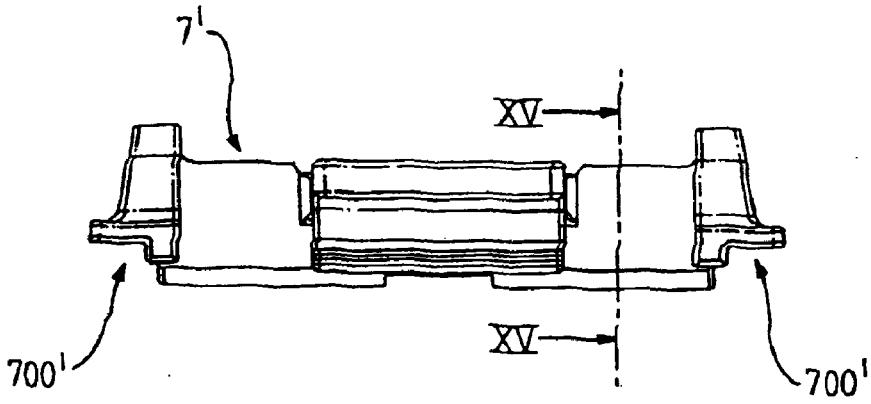
FIG. 15 shows modifications to the assembly of FIG. 1, FIG. 15A showing a front view of a modified sidepost insulator, FIG. 15B showing a partial cross-sectional side view taken on the line XV in FIG. 15A and FIG. 15C showing a side view of a modified anchoring device.
Figure 15B:
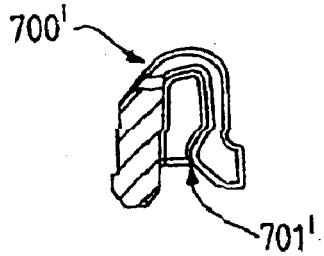
Figure 15C:
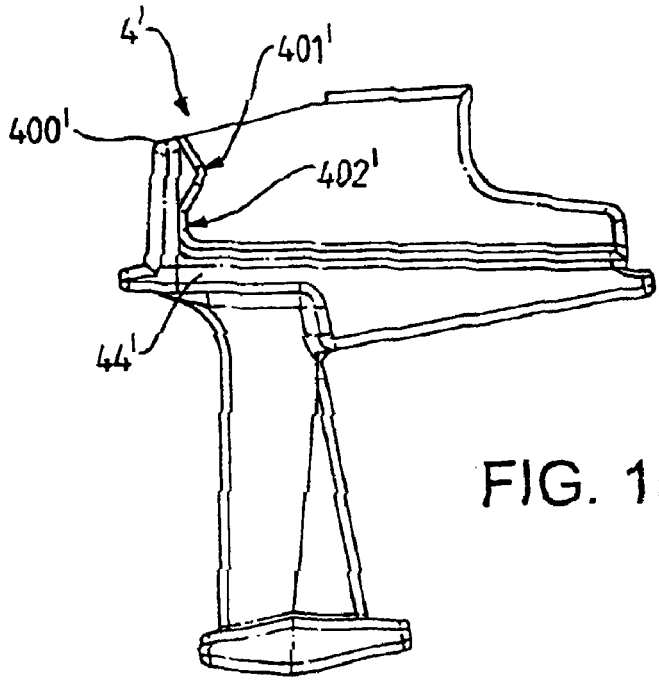

A modification to the assembly of FIG. 1 is shown in FIGS. 15A, 15B and 15C. As shown in FIG. 15C, an anchoring device 4', similar in other respects to the anchoring device 4 of FIG. 1, is provided with respective outer wings 400' at each side of the body 44' of the anchoring device 4', each wing 400' being formed, on the side facing away from the rail 1 when in use, with a protrusion 401'. Below each protrusion 401' a recess 402' is formed. As shown in FIGS. 15A and 15B, a sidepost insulator 7', similar in other respects to the sidepost insulator 7 of FIG. 1, is formed at end parts 700' thereof with respective protrusions 701', which, when the sidepost insulator 7' is pushed vertically downwards onto the front of the anchoring device 4', is displaced by the protrusion 401' on the anchoring device 4'. Upon passing the protrusion 401', the protrusion 701' on the sidepost insulator 7' returns to its undeflected condition and sits in the recess 402', thereby resisting unintentional vertical displacement of the insulator 7'.

What is claimed is:

1. A railway rail fastening assembly for fastening a railway rail (1) to an underlying rail foundation (2), the assembly comprising:

a pair of railway rail fastening clips (3), each clip (3) having a first portion (33), serving as a toe portion (33) for bearing on the railway rail (1), and a second portion (32) for engaging a rail fastening clip anchoring device (4) secured to the rail foundation (2), the clip (3) being capable of being retained in the assembly in a pre-assembly position in which the clip (3) does not bear on the rail (1);

a pair of electrically insulating toe insulators (5), each insulator (5) having a cavity (51) within which the toe portion (33) of the clip (3) is located, whereby the clip (3) is electrically insulated from the rail (1), the insulator being retained on the toe portion (33) of the clip (3) by insulator retaining means (34A, 34B) provided on the toe portion (33) of the clip (3) which engage corresponding means (52) on the insulator (5); and a pair of rail fastening clip anchoring devices (4), each anchoring device (4) having a passageway (45) within which the second portion of the clip (3) is located when the clip (3) is bearing on the rail (1);

characterised in that each clip (3) is formed of an elongate plate shaped such that a central region (31) of the plate has in profile the form of a letter C, a first end region of the plate extending from one side of the central region (31) to form the second portion (32) of the clip (3), which serves as a base portion (32), and a second end region of the plate extending from the opposite side of the central region (31) of the plate to form the said toe portion (33) of the clip (3);

and in that an upper surface (441) of each anchoring device (4) is formed with a step (442) which engages the toe insulator (5) to Inhibit unintentional removal of the clip from the device (4) when the clip is in its pre-assembly position.

2. An assembly clip as claimed in claim 1, wherein the toe portion (33) of the clip (3) comprises, proceeding from the central region (31) of the plate, a first section, extending towards the base portion (32) of the clip (3), and then a straight second section extending away from the base portion (32), the insulator retaining means (34A, 34B; 52) being provided on said second section.

3. An assembly as claimed in claim 1 or 2, wherein the insulator retaining means (34A, 34B; 52) comprise a notch (34A, 34B) formed in the toe portion (33) and a projection (52) formed within the cavity (51) of the toe insulator (5) for engaging the notch (34A, 34B).

4. An assembly as claimed in claim 3, wherein the notch (34A, 34B) extends across the toe portion (33).

5. An assembly as claimed in claim 1 or 2, wherein the toe portion (33) of the clip (3) is bifurcated and each part (33A, 33B) of the toe portion (33) is provided with insulator retaining means (34A, 34B) for retaining thereon respective toe insulators (5) for electrically insulating the clip (3) from the rail (1).

6. An assembly as claimed in claim 5, wherein the insulator retaining means (34A, 34B) comprise respective notches (34A, 34B) formed in each part (33A, 33B) of the toe portion (33) for engaging with respective projections (52) on the toe insulators (5).

7. An assembly as claimed in claim 6, wherein the notches (34A, 34B) extend respectively across the parts (33A, 33B) of the toe portion (33).

8. An assembly as claimed in claim 5, wherein the central portion (31) of the plate forming the clip (3) is not bifurcated.

9. An assembly as claimed in claim 3, wherein the or each notch (34A, 34B) is provided on a lower surface of the toe portion (33).

10. An assembly as claimed in claim 3, wherein the or each notch (34A, 34B) has an abutment face (341) which is substantially perpendicular to the direction in which the clip (3) is to be driven onto the rail (1).

11. An assembly as claimed in claim 10, wherein the or each notch (34A, 34B) has an inclined face (343) extending away from and opposite to the said abutment surface (341).

12. An assembly as claimed in claim 1, wherein the width of the toe portion (33) of the clip (3) is substantially the same as that of the base portion (32) of the clip (3).

13. An assembly as claimed in claim 1, wherein the base portion (32) of the clip (3) is planar.

14. An assembly as claimed in claim 1, wherein the base portion (32) of the clip (3) has a recess (35), provided adjacent to a free end (36) of the base portion (32), for engaging part (48) of the rail clip anchoring device (4).

15. An assembly as claimed in claim 14, wherein the recess (35) is provided on an upper surface of the base portion (32) of the clip (3).

16. An assembly as claimed in claim 1, wherein the passageway (45) of each anchoring device (4) has a roof (47).

17. An assembly as claimed in claim 14, wherein a locating projection (48) is formed on the roof (47) inside the passageway (45) in the anchoring device (4) for engaging with the recess (35) on the base portion (32) of the clip (3).

18. An assembly as claimed in claim 16, wherein the roof (47) extends over almost the entire passageway (45).

19. An assembly as claimed in claim 1, further comprising a pair of sidepost insulators (7) for insulating the anchoring devices (4) from the rail (1), each anchoring device (4) having means (49) for locating a sidepost insulator (7) thereon.

20. An assembly as claimed in claim 19, wherein each anchoring device (4) has an aperture (49) at the end of the passageway (45) opposite to an entrance thereof, and each sidepost insulator (7) has a portion (71) which projects into that aperture (49), the portion (71) of the sidepost insulator (7) projecting into the aperture (49) having a recess (72) therein into which the base portion (32) of the clip (3) projects, thereby to prevent vertical displacement of the sidepost insulator (7).

21. An assembly as claimed in claim 19, wherein each anchoring device (4') has a protrusion (401') and a recess (402') at the end of the passageway (45) adjacent to the sidepost insulator (7') and each sidepost insulator (7') has a protrusion (701') which projects into the recess (402'), which protrusions (401', 701') act to resist unintentional vertical displacement of the sidepost insulator (7').

22. A railway rail fastening assembly for fastening a railway rail (1) to an underlying rail foundation (2), the assembly comprising:

a pair of railway rail fastening clips (3), each clip (3) having a first portion (33), serving as a toe portion (33) for bearing on the railway rail (1), and a second portion (32) for engaging a rail fastening clip anchoring device (4) secured to the rail foundation (2), the clip (3) being capable of being retained in the assembly in a pre-assembly position in which the clip (3) does not bear on the rail (1);

a pair of electrically insulating toe insulators (5), each insulator (5) having a cavity (51) within which the toe portion (33) of the clip (3) is located, whereby the clip (3) is electrically insulated from the rail (1), the insulator being retained on the toe portion (33) of the clip (3) by insulator retaining means (34A, 34B) provided on the toe portion (33) of the clip (3) which engage corresponding means (52) on the insulator (5); and a pair of rail fastening clip anchoring devices (4), each anchoring device (4) having a passageway (45) within which the second portion of the clip (3) is located when the clip (3) is bearing on the rail (1);

characterised in that each clip (3) is formed of an elongate plate shaped such that a central region (31) of the plate has in profile the form of a letter C, a first end region of the plate extending from one side of the central region (31) to form the second portion (32) of the clip (3), which serves as a base portion (32), and a second end region of the plate extending from the opposite side of the central region (31) of the plate to form the said toe portion (33) of the clip (3);

and in that an upper surface (441) of each anchoring device (4) is formed with a step (442) which engages the toe insulator (5) to inhibit unintentional removal of the clip from the device (4), wherein the toe portion (33) of the clip (3) comprises, proceeding from the central region (31) of the plate, a first section, extending towards the base portion (32) of the clip (3), and then a straight second section extending away from the base portion (32), the insulator retaining means (34A, 34B; 52) being provided on said second section.

23. A railway rail fastening assembly for fastening a railway rail (1) to an underlying rail foundation (2), the assembly comprising:

a pair of railway rail fastening clips (3), each clip (3) having a first portion (33), serving as a toe portion (33) for bearing on the railway rail (1), and a second portion (32) for engaging a rail fastening clip anchoring device (4) secured to the rail foundation (2), the clip (3) being capable of being retained in the assembly in a pre-assembly position in which the clip (3) does not bear on the rail (1);

a pair of electrically insulating toe insulators (5), each insulator (5) having a cavity (51) within which the toe portion (33) of the clip (3) is located, whereby the clip (3) is electrically insulated from the rail (1), the insulator being retained on the toe portion (33) of the clip (3) by insulator retaining means (34A, 34B) provided on the toe portion (33) of the clip (3) which engage corresponding means (52) on the insulator (5); and a pair of rail fastening clip anchoring devices (4), each anchoring device (4) having a passageway (45) within which the second portion of the clip (3) is located when the clip (3) is bearing on the rail (1);

characterised in that each clip (3) is formed of an elongate plate shaped such that a central region (31) of the plate has in profile the form of a letter C, a first end region of the plate extending from one side of the central region (31) to form the second portion (32) of the clip (3), which serves as a base portion (32), and a second end region of the plate extending from the opposite side of the central region (31) of the plate to form the said toe portion (33) of the clip (3);

and in that an upper surface (441) of each anchoring device (4) is formed with a step (442) which engages the toe insulator (5) to inhibit unintentional removal of the clip from the device (4)

wherein the insulator retaining means (34A, 34B; 52) comprise a notch (34A, 34B) formed in the toe portion (33) and a projection (52) formed within the cavity (51) of the toe insulator (5) for engaging the notch (34A, 34B).

24. An assembly as claimed in claim 22, wherein the insulator retaining means (34A, 34B; 52) comprise a notch (34A, 34B) formed in the toe portion (33) and a projection (52) formed within the cavity (51) of the toe insulator (5) for engaging the notch (34A, 34B).

25. An assembly as claimed in claim 24, wherein the notch (34A, 34B) extends across the toe portion (33).

26. An assembly as claimed in claim 22, wherein the toe portion (33) of the clip (3) is bifurcated and each part (33A, 33B) of the toe portion (33) is provided with insulator retaining means (34A, 34B) for retaining thereon respective toe insulators (5) for electrically insulating the clip (3) from the rail (1).

27. An assembly as claimed in claim 26, wherein the insulator retaining means (34A, 34B) comprise respective notches (34A, 34B) formed in each part (33A, 33B) of the toe portion (33) for engaging with respective projections (52) on the toe insulators (5).

28. An assembly as claimed in claim 27, wherein the notches (34A, 34B) extend respectively across the parts (33A, 33B) of the toe portion (33).

* * * * *